US006146178A

United States Patent [19]

Walkup et al.

[11] Patent Number: 6,146,178

[45] Date of Patent: Nov. 14, 2000

[54] CAM MECHANISM FOR A ZERO-INSERTION-FORCE CONNECTOR

[75] Inventors: William B. Walkup, Hillsboro, Oreg.; Wen-Chun Pei, Taipei, Taiwan

[73] Assignee: Hon Hai Precision Ind. Co., Ltd., Taipei Hsien, Taiwan

[21] Appl. No.: 09/405,378

[22] Filed: Sep. 24, 1999

[51] Int. Cl.[7] ..... H01R 13/631

[52] U.S. Cl. ..... 439/342

[58] Field of Search ..... 439/342, 259–270

[56] References Cited

U.S. PATENT DOCUMENTS 5,707,247 1/1998 Konstad ..... 439/342

5,855,489 1/1998 Walker ..... 439/342

*Primary Examiner*—Gary F. Paumen

*Attorney, Agent, or Firm*—Wei Te Chung

[57] ABSTRACT

A cam mechanism for driving a zero-insertion-force connector between open and closed positions is disclosed. The connector include a base for being mounted to a mother board. A cover is slidably mounted on the base. The cam mechanism includes a cam having a head rotatably mounted on the base, a body located between the base and the cover and a bottom face supported by the cover. First and second depressions are formed on the body of the cam and angularly spaced from each other 90 degrees. A positioning arm is integrally formed with the base. The positioning arm has a bulge formed at its free end. When the cam is rotated to a position wherein the bulge is fittingly received in the first depression, the cam pushes the cover relative to the base to reach the open position. When the cam is rotated to a position wherein the bulge is fittingly received in the second depression, the cam pushes the cover relative to the base to reach the closed position.

12 Claims, 5 Drawing Sheets

CAM MECHANISM FOR A ZERO-INSERTION-FORCE CONNECTOR

BACKGROUND OF THE INVENTION

Field of the Invention

The present invention is related to a zero-insertion-force (hereafter ZIF) connector, and particularly to a cam mechanism for a ZIF connector which can reliably motivate the ZIF connector between open and closed positions.

As the functions of a CPU increases, pins thereof increase accordingly. To mount the CPU with so many pins to a connector needs a very large insertion force. Such a large insertion force will cause a difficulty for mount/dismount the CPU to/from the connector, and more seriously, a damage of the pins of the CPU or contacts of the connector if there is a deviation of positional precision of the pins or the contacts. Thus, a ZIF connector is developed which when at an open position the pins can be freely inserted into the connector without engagement with the contacts. Then, a cover of the ZIF connector is motivated by driving a cam mechanism thereof to a closed position thereby moving the pins to engage with the contacts.

The conventional cam mechanism for motivating the ZIF connector has a complicated structure which causes it to have a high cost. Furthermore, there is no locating device in the conventional cam mechanism to make sure that the ZIF connector is motivated to the open or closed position. Finally, the conventional mechanism has a lever moving in a direction perpendicularly to the plane on which the connector extends for driving the cam mechanism. Such a perpendicular movement of the lever is not convenient to manipulate.

Hence, an improved cam mechanism for a ZIF connector is needed to eliminate the above mentioned defects of current art.

SUMMARY OF THE INVENTION

Accordingly, an objectives of the present invention is to provide a cam mechanism for a ZIF connector wherein the cam mechanism has a simple structure so that it can be easily assembled and has a low cost.

Another objective of the present invention is to provide a cam mechanism for a ZIF connector wherein the cam mechanism has a locating device by which a user can make sure whether the ZIF connector has reached the open or closed position.

A further objective of the present invention is to provide a cam mechanism for a ZIF connector wherein the cam mechanism is convenient to operate.

To fulfill the above mentioned objective, according to one embodiment of the present invention, a cam mechanism for a ZIF connector includes a cam having a head for receiving a rotation force and a body portion below the head and defining first and second actuating faces and first and second depressions angularly spaced from each other 90 degrees. The head of the cam is received in a base of the ZIF connector, wherein the base has a rectangular main portion receiving a number of contacts for being soldered to a printed circuit board and engaging with pins of a CPU inserted into the connector. The body of the cam is supported by a stud of a cover of the ZIF connector, wherein the cover has a rectangular main portion slidably mounted on the main portion of the base and defines a number of holes through which the pins of the CPU extend to enter the base. A locating arm in the form of a cantilever is integrally formed with the base, and has a bulge on its free end. When the cam is rotated on the plane on which the connector extends to a first position wherein the bulge is fitted within the first depression, the first actuating face of the body of the cam motivates the cover relative to the base to an open position. At the open position, the pins of the CPU disengage from the contacts of the connector. When the cam is rotated to a second position wherein the bulge is fitted within the second depression, the second actuating face of the body of the cam motivates the cover relative to the base to a closed position. At the closed position, the pins of the CPU engage with the contacts of the connector.

DETAILED DESCRIPTION OF THE PREFERRED EMBODIMENT

Reference will now be made in detail to the preferred embodiment of the present invention.

Figure 1:
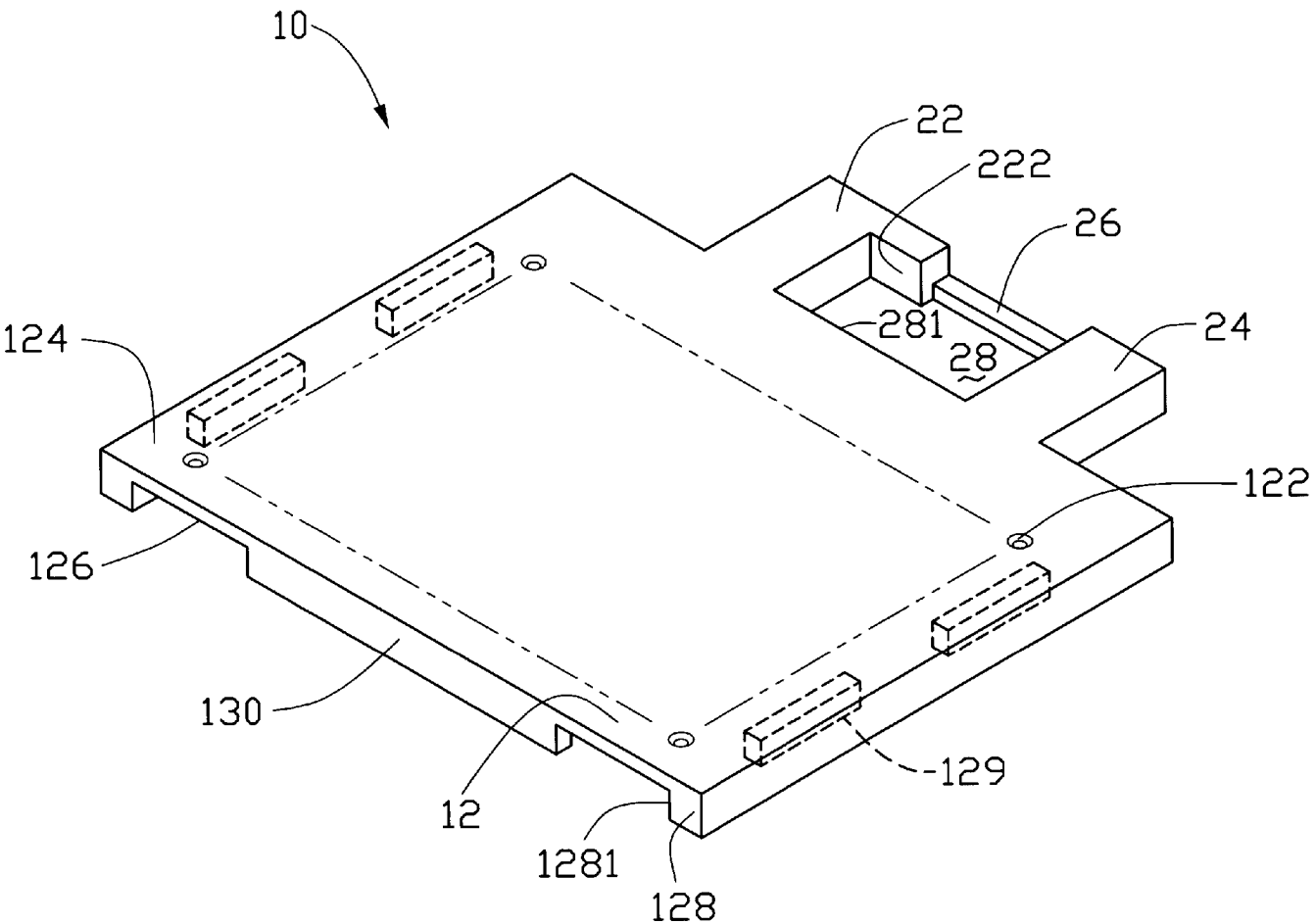
FIG. 1 is a perspective view of a cover of a ZIF connector in accordance with the present invention.

Referring to FIG. 1, a cover 10 of a ZIF connector 1 (FIG. 7) is shown. The cover 10 is made by plastics injection molding to have a rectangular main body 12 defining a number of round holes 122 extending through top and bottom faces 124, 126 thereof. Two guiding walls 128 are formed on two lateral sides of the main body 12 extending downwardly from the bottom face 126. Each guiding wall 128 defines two rectangular recesses 129 depressed laterally from an inner face 1281 thereof. A stop wall 130 is downwardly extended from a front side of the bottom face 126. An L-shaped lug 22 and a straight lug 24 extend rearwardly from a rear side of the main body 12. Distal ends of the two lugs 22, 24 are connected together by a stud 26. The lugs 22, 24, the stud 26 and a portion of the rear side of the main body 12 between the two lugs 22, 24 cooperatively define a first cam receiving space 28 therebetween. The portion of the rear side of the main body 12 between the two lugs 22, 24 defines a first actuated face 281. A side of the free end of the L-shaped lug 22 near the space 28 defines a second actuated face 222.

Figure 2:
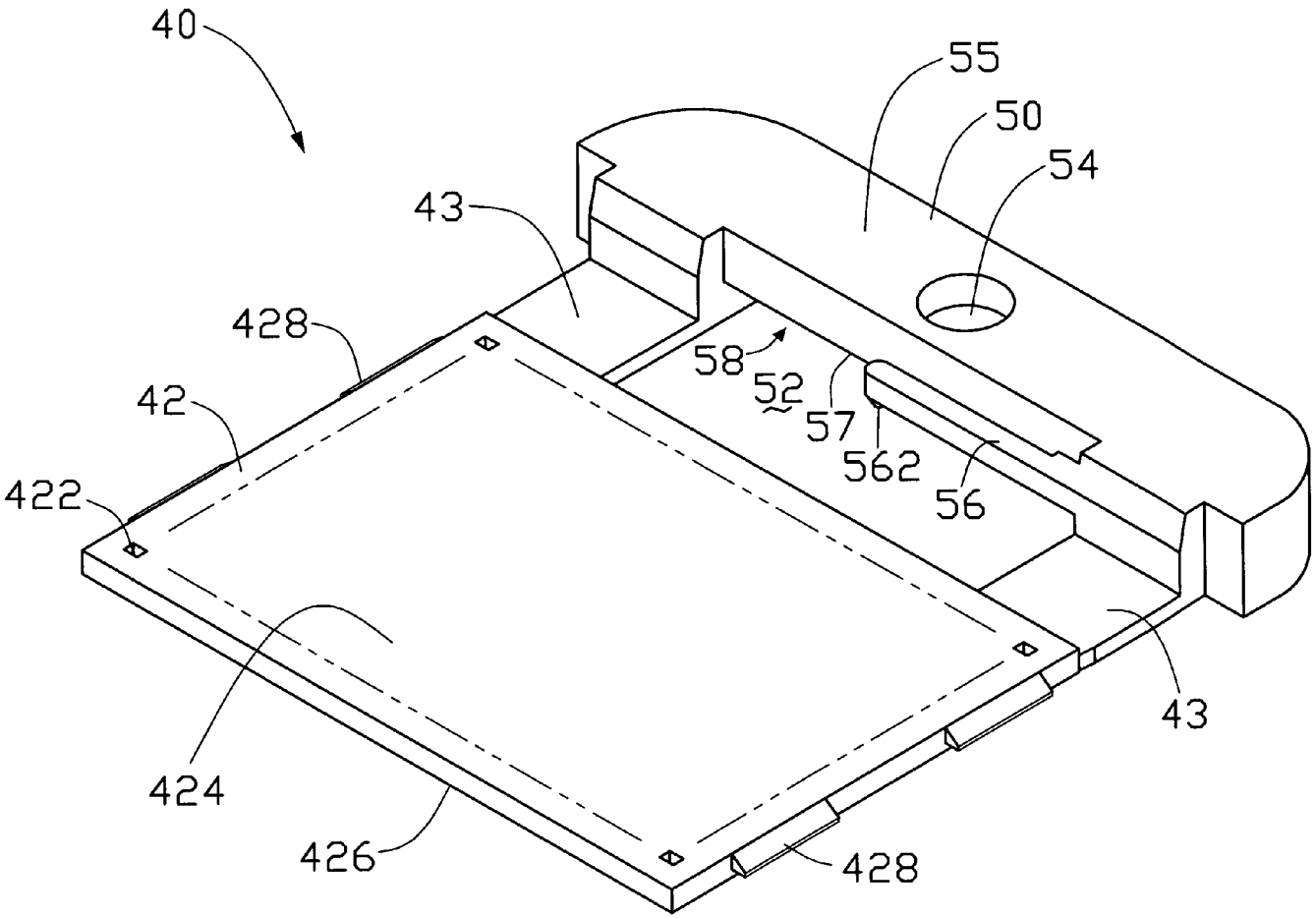
FIG. 2 is a perspective view of a base of the ZIF connector in accordance with the present invention.
Figure 4:
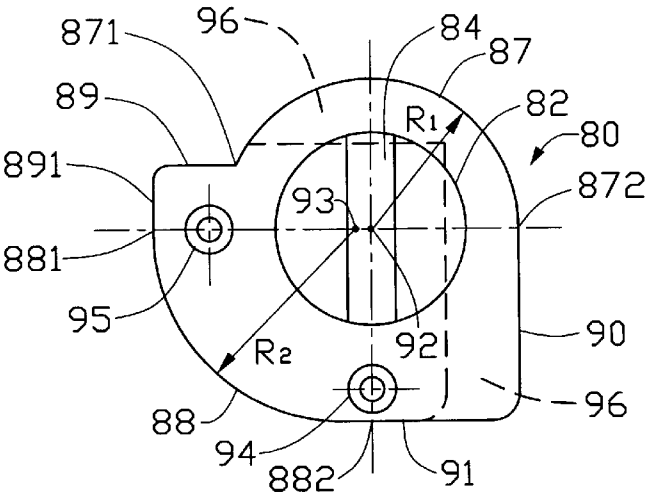
FIG. 4 is a top view of the cam of FIG. 3.
Figure 6:
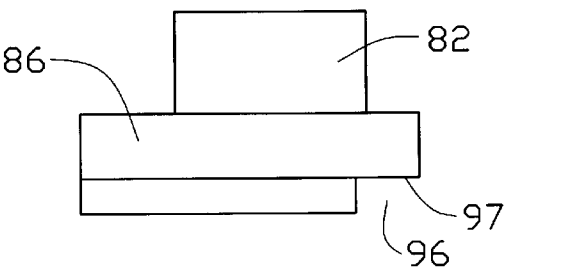
FIG. 6 is a right side view of the cam of FIG. 3.
Figure 3:
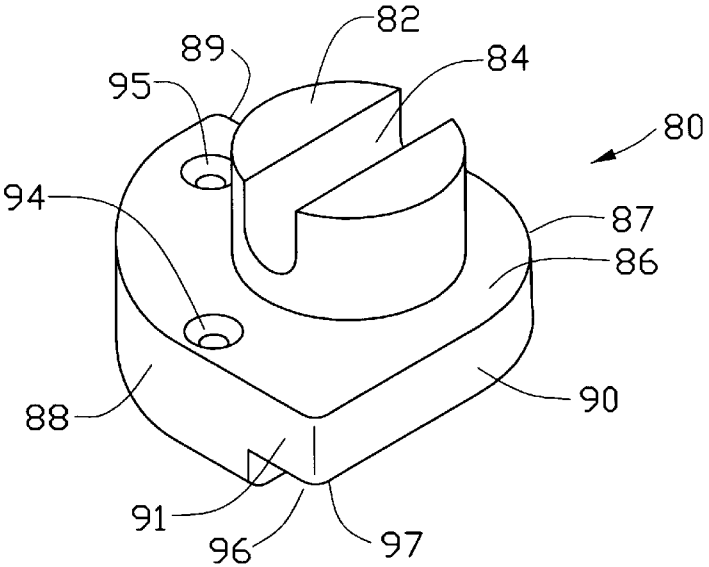
FIG. 3 is a front-right-top perspective view of a cam of the ZIF connector in accordance with the present invention.
Figure 5:
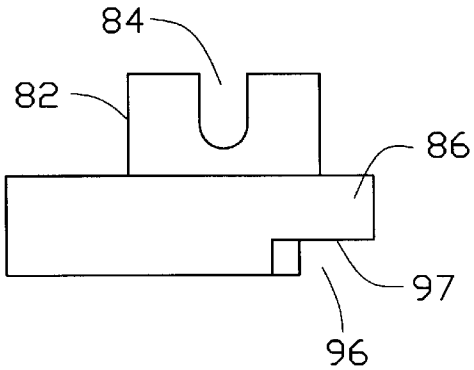
FIG. 5 is a front view of the cam of FIG. 3.

Referring to FIG. 2, a base 40 of the connector 1 is shown. The base 40 is also formed by plastics injection molding. The base 40 includes a rectangular main body 42 defining a number of rectangular holes 422 extending through top and bottom faces 424, 426 thereof. The rectangular holes 422 are used for interferentially receiving a corresponding number of contacts (not shown) of the connector 1 therein. As known by those skilled in the art, each contact has a tail portion for being electrically connected to a printed circuit board by a suitable means, for example, soldering. Two latches 428 protrude from each of two lateral sides of the main body 42. Two lugs 43 extend rearwardly from a rear side of the main body 42 near the two lateral sides. Each lug 43 has a thickness smaller than that of the main body 42. A bridge 50 connects distal ends of the two lugs 43. The two lugs 43, the bridge 50 and a portion of the rear side of the main body 42 between the two lugs 43 cooperatively define a second cam receiving space 52 therebetween. The bridge 50 defines a round through hole 54 located generally at a middle thereof. A positioning arm 56 in the form of a cantilever integrally extends from a right side of the bridge 50 into the second cam receiving space 52. The positioning arm 56 has a semi-spherical bulge 562 projecting downwardly from a bottom face of a free end of the positioning arm 56. A middle portion 55 of the bridge 50 has a raised bottom face 57 so that a third cam receiving space 58 is formed below the bottom face 57 of the middle portion 55 of the bridge 50. The third cam receiving space 58 communicates with the second cam receiving space 52.

Referring to FIGS. 3–6, a cam 80 for driving the ZIF connector 1 in accordance with the present invention is shown. The cam 80 is made of metal and includes a round head 82 defining a central slot 84 for engaging with a driving tool such as a screwdriver to receive a rotation force therefrom. The round head 82 has a center 92. A body portion 86 is located below the head 82 and formed with a circumferential periphery constituted of first and second arcs 87, 88. The two arcs 87, 88 are positioned generally opposite to each other. A first straight line 89 extends leftwardly from a first end 871 of the first arcs 87. A second straight line 891 extends rearwardly from a first end 881 of the second arc 88 to intercept with the first straight line 89 by a right angle. A third straight line 90 extends forwardly from a second end 872 of the first arc 87 and a fourth straight line 91 extends rightwardly from a second end 882 of the second arc 88 to intercept with the third straight line 90 by a right angle. The circumferential periphery of the body portion 86 defined by the first and second straight lines 89, 891 functions as first and second actuating planes. The first arc 87 has a curvature center coincident to the center 92 of the round head 82 and a curvature radius R1. The second arc 88 has a curvature center 93 offsetting leftwardly a distance from the center 92 and a curvature radius R2 which is larger than the curvature radius R1. First and second truncated cone-shaped depressions 94, 95 are formed in the body 86, angularly spacing from each other 90 degrees. The first and second depressions 94 are located near the second arc 88. A cut 96 is defined in a bottom face 97 of the cam 80 along the third straight line 90 and the first arc 87.

Figure 7:
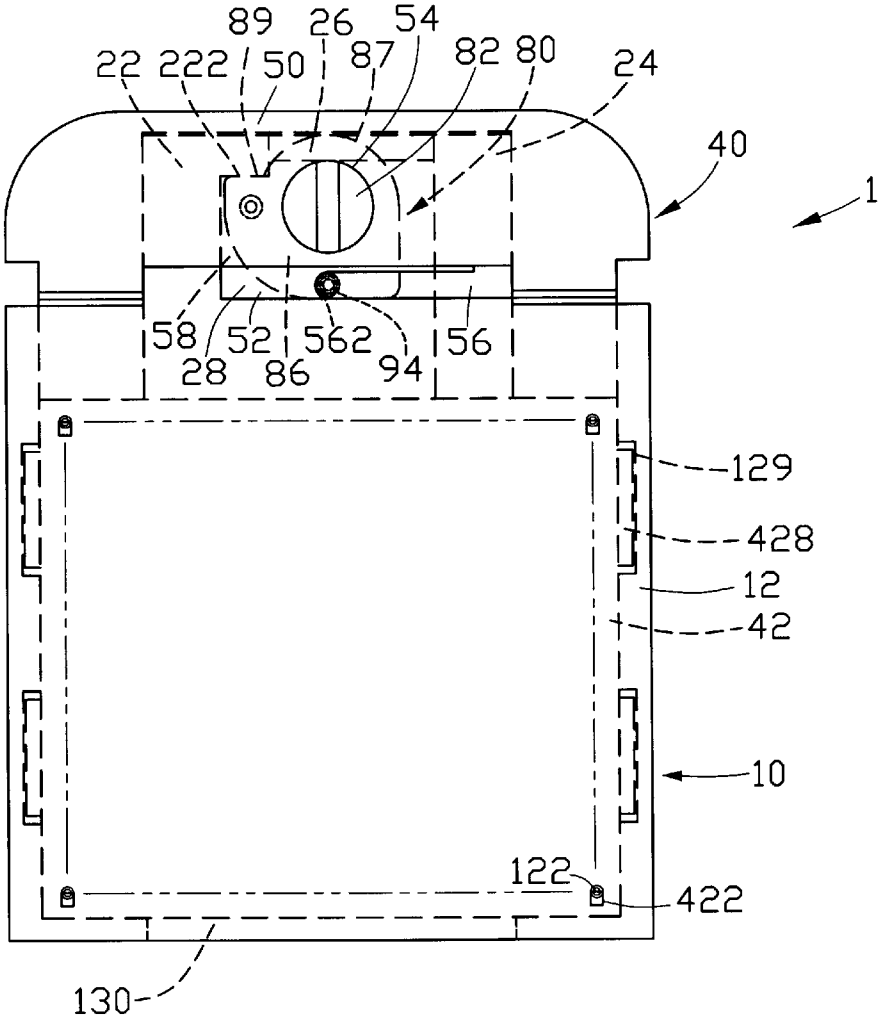
FIG. 7 is a top diagrammatic view of the ZIF connector at an open position.

Referring to FIGS. 7, to assemble the connector 1, the cam 80 is firstly mounted to the base 40 by extending the round head 82 of the cam 80 into the round hole 54 of the bridge 50 of the base 40, whereby the cam 80 is received in the second and third cam receiving spaces 52, 58. Thereafter, the cover 10 is mounted to the base 40 by inserting the lugs 22, 24 and stud 26 into the third cam receiving space 58 through the second cam receiving space 52 to reach a position in which the stud 26 supportively engages with the bottom face 97 of the cam 80 in the cut 96 near the first arc 87. The main body 12 of the cover 10 is located over the main body 42 of the base 40. The latches 428 are slidably received in the recesses 129. When the connector 1 is assembled, the second cam receiving space 52 is located above and in communication with the first cam receiving space 28. The bulge 562 of the positioning arm 56 is fitted within the first depression 94. In the position of FIG. 7, the ZIF connector 1 is at an open position wherein pins of a CPU (not shown) can be inserted into the rectangular holes 422 of the base 40 through the round holes 122 of the cover 10 without engaging with the contacts (not shown) received in the rectangular holes 422.

Figure 8:
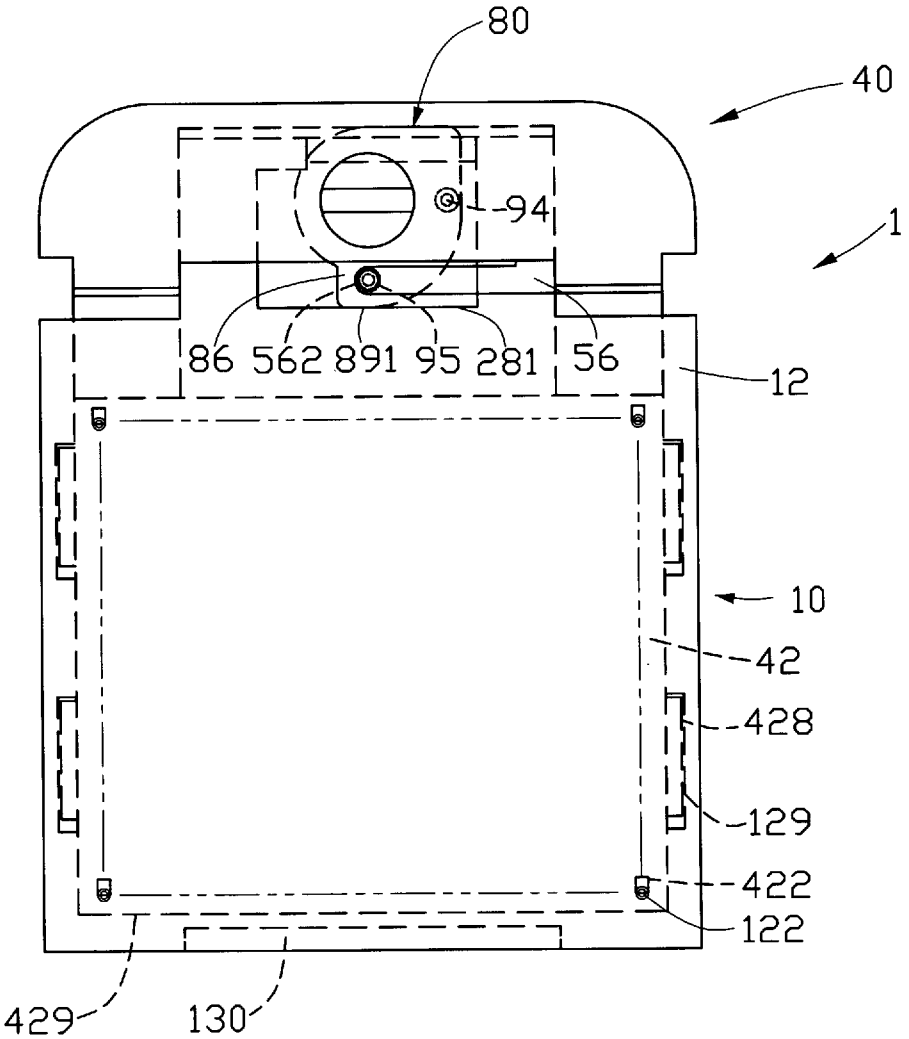
FIG. 8 is a view similar to FIG. 7, showing the ZIF connector at a closed position.

To rotate the cam 80 counterclockwise 90 degrees to reach the position as shown in FIG. 8, the arc 88 and the second actuating plane defined by the second straight line 891 of the body 86 of the cam 80 push the first actuated surface 281 of the cover 10 forwardly to cause the cover 10 to move relative to the base 40 to reach the closed position. At the closed position, the bulge 562 of the positioning arm 56 is fitted within the second depression 95. Furthermore, the pins of the CPU are moved to engage with the contacts of the connector 1.

To rotate the cam 80 clockwise 90 degrees to return to the position of FIG. 7, the first actuating plane defined by the first straight line 89 of the body 86 of the cam 80 pushes the second actuated surface 222 of the cover 10 rearwardly to cause the cover 10 to move relative to the base 40 to return to the open position. At the open position, the stop wall 130 of the cover 10 engages with a rear side 429 of the main body 42 of the base 40.

In the present invention, by the provision of the bulge and depression as locating indices, whether the connector has reached the open or closed position can be reliably ensured.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A zero-insertion-force connector for connecting an electrical component to a substrate, comprising:

a base having a main body defining a number of holes which receive a corresponding number of contacts therein, the contacts adapted to be electrically connected to the substrate;

a cover slidably mounted on the base between open and closed positions, at whereby the open position, pins of the electrical component extend into the holes of the base via the cover and are disengaged from the contacts, and at the closed position, the pins are engaged with the contacts;

a cam mechanism for moving the cover relative to the base between the open and closed positions, said cam mechanism comprising:

a cam having a head rotatably received in the cover for receiving a rotation force, a body located below the head and defining first and second positioning indices, said body having a bottom face with a portion supported by the cover; and a locating device having a third positioning index;

where when the cam is rotated to a first position wherein the third positioning index engages with the first positioning index, the body of the cam moves the cover relative to the base to reach the open position, and wherein when the cam is rotated to a second position where the third positioning index engages with the second positioning index, the body of the cam moves the cover relative to the base to reach the closed position;

wherein the locating device is a cantilever integrally formed with the base, the third positioning index being a bulge formed on a free end of the cantilever;

wherein the first and second positioning indices are first and second depressions formed on the body of the cam, whereby at the first position, the bulge is fited within the first depression, and at the second position, the bulge is fitted within the second depression;

wherein the first and second depressions are angularly spaced from each other by ninety degrees;

wherein the cover comprises first and second lugs extending from a main body of the cover over the main body of the base, and a stud connects the lugs, a side of the main body of the cover located between the lugs, the lugs and the stud cooperatively defining a first cam receiving space therebetween;

wherein the head of the cam is round in shape and has a rotation center, the body of the cam having a circumferential periphery comprised of at least first and second arcs generally opposite to each other, the first arc has a curvature center coincident to the rotation center of the head and a curvature radius R1, the second arc having a curvature center offset from the rotation center of the head and a curvature radius R2 which is larger than R1.

2. The connector in accordance with claim 1, wherein the portion of the bottom face of the body of the cam supported by cover is supported by the stud.

3. The connector in accordance with claim 2, wherein the portion of the bottom face of the body of the cam supported by the stud is located in a cut defined in the bottom face.

4. The connector in accordance with claim 3, wherein the cut is defined along a portion of a circumferential periphery of the cam.

5. The connector in accordance with claim 1, wherein the first lug is straight in shape, the second lug is L-shaped, and the stud connects free ends of the two lugs, when the cam is rotated to the first position, the body of the cam pushing a side of the free end of the L-shaped lug to motivate the cover relative to the base to reach the open position.

6. The connector in accordance with claim 1, wherein when the cam is rotated to the second position, the body of the cam pushes the side of the main body of the cover defining the first cam receiving space to motivate the cover relative to the base to reach the closed position.

7. The connector in accordance with claim 1, wherein the base comprises two lugs extending from the main body of the base, a bridge connecting the two lugs, a side of the main body of the base between the two lugs, the two lugs and the bridge cooperatively defining a second cam receiving space therebetween, the second cam receiving space being located above and in communication with the first cam receiving space, the bridge defining a hole receiving the head of the cam.

8. The connector in accordance with claim 7, wherein the locating device is a cantilever integrally formed with a lateral side of the base, the cantilever having a free end extending to the second cam receiving space, the free end being formed with a bulge projecting toward the first cam receiving space, the bulge functioning as the third positioning index.

9. The connector in accordance with claim 8, wherein the first and second locating indices are first and second depressions formed on the body of the cam.

10. The connector in accordance with 9, wherein the first and second depressions are angularly spaced from each other 90 degrees.

11. The connector in accordance with claim 1, wherein the head of the cam defines a slot for engaging a tool to receive a rotation force from the tool.

12. The connector in accordance with claim 1, wherein the first and second positioning indices are first and second depressions formed on the body near the second arc.

* * * * *